United States Patent [19]

Johnson

[11] Patent Number: 5,062,223

[45] Date of Patent: Nov. 5, 1991

[54] ADJUSTABLE SHOE COVERING

[75] Inventor: Gregory K. Johnson, Palo Alto, Calif.

[73] Assignee: Innova Products, Inc., Santa Clara, Calif.

[21] Appl. No.: 549,252

[22] Filed: Jul. 6, 1990

Related U.S. Application Data

[63] Continuation of Ser. No. 293,944, Jan. 5, 1989, abandoned.

[51] Int. Cl.[5] ..... A43B 17/14

[52] U.S. Cl. ..... 36/7.1 R; 36/9 R; 36/9 A

[58] Field of Search ..... 36/7.1 R, 7.2, 3 A, 36/9 R, 1, 4, 7.3, 72 R, 7.1 A, 73; 361/223; 12/142 K, 142 R, 142 G; 206/633

[56] References Cited

U.S. PATENT DOCUMENTS

| | | | |
|---|---|---|---|
| 1,717,690 | 6/1929 | Ihnen | 36/7.1 R |
| 1,748,607 | 2/1930 | Jarrett | 36/1 |
| 2,176,463 | 10/1939 | Meendsen | 36/7.1 R |
| 2,651,857 | 9/1953 | Griswold et al. | 12/142 K |
| 2,654,964 | 10/1953 | Stoll | 36/4 |
| 2,755,566 | 7/1956 | Harrison | 36/4 |
| 2,924,029 | 2/1960 | Rosen | 36/7.1 R |
| 2,986,823 | 6/1961 | Kos | 36/7.1 R |
| 3,177,596 | 4/1965 | Siger | 36/7.1 R |
| 3,260,358 | 7/1966 | Gottily et al. | 206/633 |
| 3,337,770 | 8/1967 | Saraceni et al. | 317/2 |
| 3,358,188 | 12/1967 | Zimmon | 317/2 |
| 3,387,180 | 6/1968 | Zipf, III | 317/2 |
| 3,516,537 | 6/1970 | Dreyfus et al. | 206/633 |
| 3,564,335 | 2/1971 | Siegel | 36/7.1 R |
| 3,634,954 | 11/1971 | Larsen et al. | 36/7.3 |
| 3,648,390 | 3/1972 | Corvi | 36/3 A |
| 3,737,723 | 6/1973 | Kanor | 361/223 |
| 4,083,124 | 4/1978 | Michalak | 36/7.1 R |
| 4,224,935 | 9/1980 | Metelnick | 36/7.1 R |
| 4,562,834 | 1/1986 | Bates et al. | 36/7.1 R |
| 4,811,499 | 3/1989 | Jensen | 36/9 A |
| 4,825,564 | 5/1989 | Sorce | 36/87 |

FOREIGN PATENT DOCUMENTS

| | | | |
|---|---|---|---|
| 3630738 | 3/1988 | Fed. Rep. of Germany | 36/7.1 R |

*Primary Examiner*—Steven N. Meyers

*Attorney, Agent, or Firm*—Flehr, Hohbach, Test, Albritton & Herbert

[57] ABSTRACT

A disposable shoe covering and a method of covering a shoe. The covering includes a boot portion designed to cover the vamp, sole and heel of a wearer's shoe. Such boot portion is designed to cooperate with a pressure sensitive adhesive securant to provide automatic precise adjustment of the fit of the covering to the shoe of a wearer when the boot portion is secured in place.

5 Claims, 2 Drawing Sheets

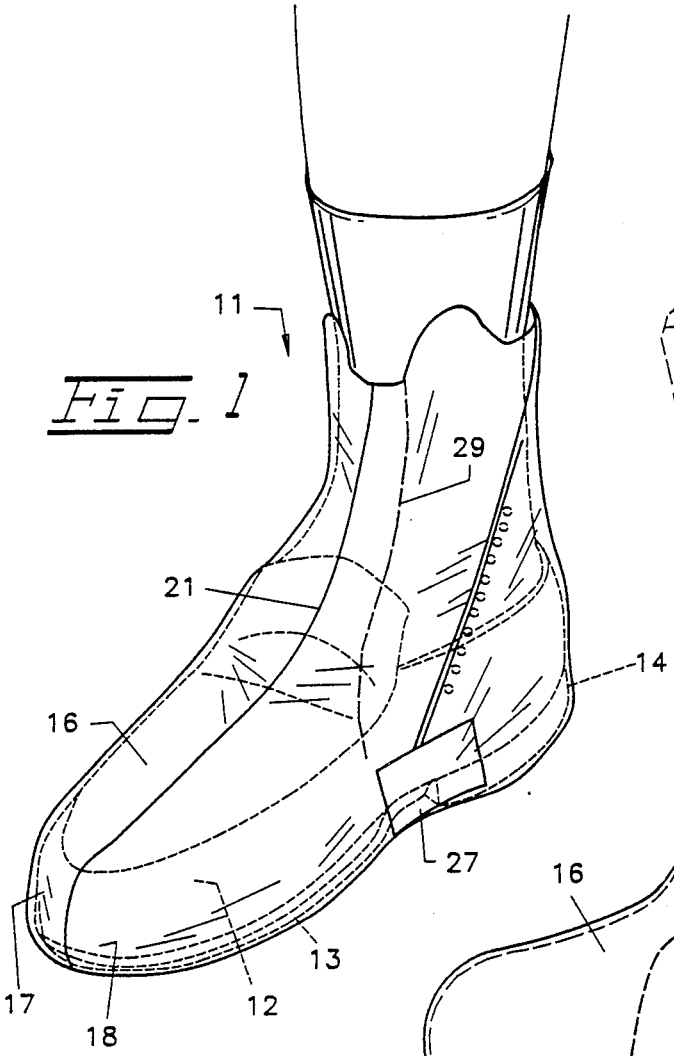
Fig. 1
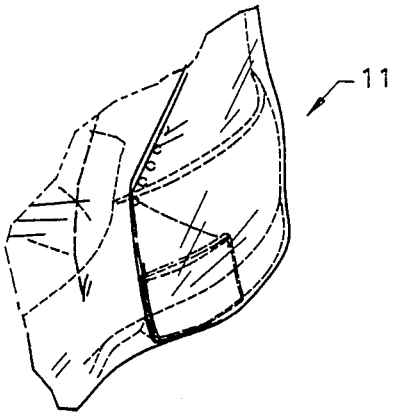
Fig. 3
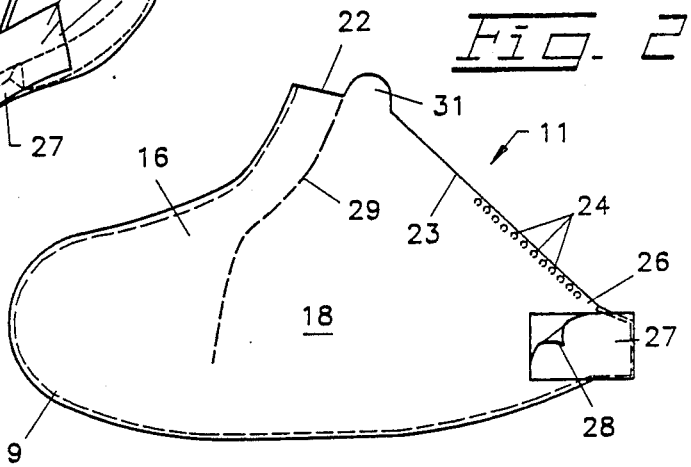
Fig. 2
Fig. 4
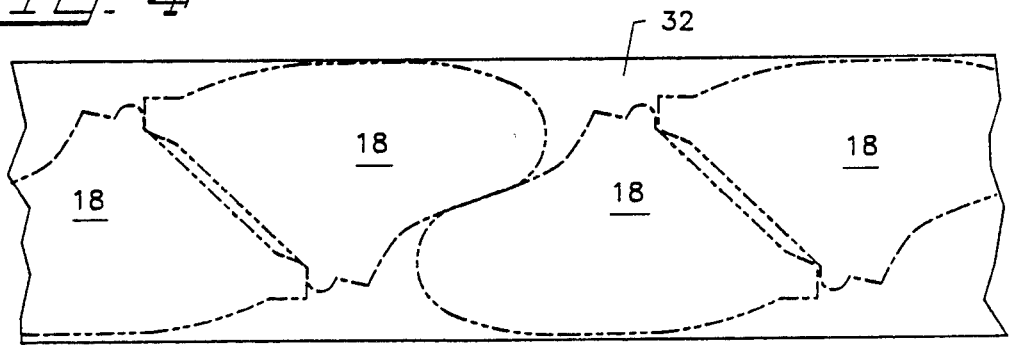

47

41
43
42
31'
44
29'
21'
16'
17'
27'
12'
18'

19'
43
42
46
31'
44
18'
29'
26'
27'
28'

ADJUSTABLE SHOE COVERING

This is a continuation of application Ser. No. 07/293,944, filed Jan. 5, 1989, which is now abandoned.

BACKGROUND OF THE INVENTION

The present invention relates to a simple, easily used disposable shoe covering which is designed to accurately accommodate differently sized shoes and yet has a reduced tendency to cause heat buildup, slippage, and the like. It also relates to a method of protecting the exterior of a shoe on a foot.

Disposable shoe coverings are used in many environments to prevent a shoe from being contaminated and/or to prevent an environment from being contaminated by a shoe. For example, surgeons and the like typically wear disposable shoe coverings to protect the operating room environment from microbial and other potential contamination by the shoes, and also to protect the shoes from contamination by blood and the like. Much effort has been made to design shoe coverings for this and other purposes. Attention is directed, for example, to U.S. Pat. Nos. 4,722,143; 4,335,527; 4,083,124; 3,694,939; 3,684,922; 3,387,180; 358,188; 3,337,770; 3,146,377; 2,924,029; 2,755,566; and 2,654,964. As will be noted, some of such designs are wrappers rather than boots, and some attempt to enclose a portion of the leg of the wearer as well as his/her foot.

While many of the prior designs have desirable features, none have been generally adopted for various reasons, one being that they all generally fail to adequately adjust to the shoes of individual wearers. Moreover, most are not easy to use. In this connection, many use inconvenient and heat trapping ties, elastic gathers or ankle enclosures. Many prior designs leak readily through sewn seams. Thus, in most situations in which disposable shoe coverings are used, such as in surgical applications, those in the field have relied on the relatively simple coverings made of a flexible material, such as waxed paper or woven polypropylene, having a sewn elastic band completely around the insertion opening to maintain the covering on the shoe. A covering of this nature has many deficiencies. Such coverings typically result in very unsure footing. That is, because such shoe coverings are made sufficiently large to accommodate large shoes, they are rather loose on most shoes and cause slippage between the shoe sole and floor.

SUMMARY OF THE INVENTION

The present invention is a disposable shoe covering which is quite easy to use and yet eliminates many of the problems associated with previous designs. In basic terms, the shoe covering of the invention includes, as is typical, a boot portion for covering both the vamp, sole and heel of a wearer's shoes. It also includes means for adjusting the fit of the boot portion over a shoe sole and heel. Most desirably the adjusting means also secures the boot portion on the foot of the wearer. This dual action is most simply accomplished by making the boot portion from a flexible material and gathering the excess material of such boot after it has been applied to a foot. A simple securing means is then used both to secure the boot portion on the foot of the wearer and to secure the boot excess material at the shoe sole and heel to inhibit slippage between it and the shoe of the wearer. Moreover, such securing means is designed to assure that the tension which secures the shoe covering to the shoe is concentrated adjacent the sole area of the shoe, so that potential uncomfortableness due to heat build-up and moisture retention is minimized. The invention also includes the method of protecting a shoe provided by the shoe covering.

The method and shoe covering of the invention include many other features and advantages. For example, as will become apparent from the following detailed description of preferred embodiments, it does not require use of sewn elastic seams that inevitably leak. It also avoids other types of constrictions, such as ties, around a wearer's ankle which will interfere with good ventilation. The design is also conducive to automated, high speed production. Other features and advantages of the invention will be described or will become apparent in the following.

BRIEF DESCRIPTION OF THE DRAWINGS

With reference to the accompanying two sheets of drawings:

FIG. 1 is an overall isometric view of a preferred embodiment of the shoe covering of the invention encompassing the shoe and lower leg of a wearer;

FIG. 2 is an elevation view of the preferred embodiment of FIG. 1;

FIG. 3 is a partial isometric view of the preferred embodiment of FIG. 1 illustrating features thereof;

FIG. 4 is a schematic plan view of a partial web or sheet of material from which blanks for forming a plurality of boot portions of the covering are formed;

DETAILED DESCRIPTION OF THE PREFERRED EMBODIMENTS

Figures 5, 6, 7:
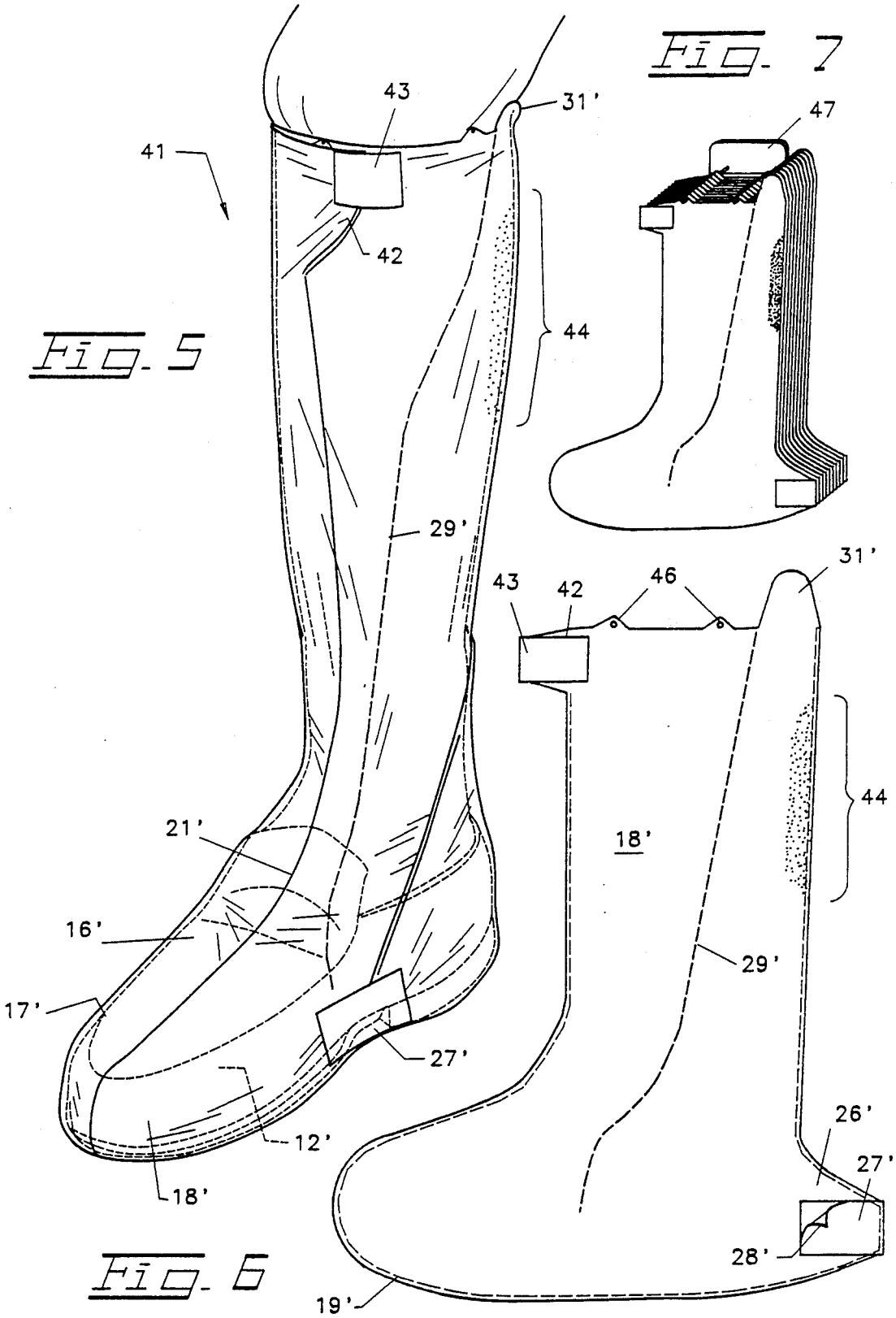
FIG. 5 is an overall isometric view of any alternative preferred embodiment of the invention, designed to cover the calf of a wearer's leg as well as his/her shoe.
FIG. 6 is an elevation view of the alternative embodiment of FIG. 5.
FIG. 7 is a reduced isometric schematic view illustrating a plurality of the shoe coverings of the FIG. 5 embodiment, mounted on a rack.

A preferred embodiment of the disposable shoe covering of the invention is generally referred to by the reference numeral 11 in FIGS. 1–3. Such covering is designed to enclose the shoe of a wearer. That is, as is illustrated in FIG. 1, the vamp 12, sole 13 and heel 14 of a shoe are encompassed by a boot portion 16 of the shoe covering. Such boot portion also encompasses the portion of the lower leg of the wearer having his/her ankle, i.e., such boot portion is sock high.

It should be noted that although a relatively conventional shoe design is illustrated in which the vamp, sole and heel are separate pieces, the invention is useful for covering shoe designs in which these pieces are integral with one another, such as in many "clog" shoe designs. Moreover, although the shoe includes a conventional heel the shoe covering of the invention is just as applicable to shoe designs in which a raised portion for the heel of the wearer's foot is not included. As used herein and in the claims, the term "heel" is meant to encompass the location at the bottom of a shoe adjacent the vamp portion encompassing the heel of a wearer's foot.

The boot portion 16 of this preferred embodiment is made from a material which is generally impermeable to passage of the contaminants against which the covering is designed to protect and is preferably flexible. For surgical applications, 2–3 mil thick sidewalls of an opaque polyethylene material have been selected to provide the boot portion sidewall panels. In this connection, the boot portion is made from a pair of side panels of thermoplastic material that are secured together via a heat seam. That is, a pair of boot sidewall panels 17 and 18 are cut out of a sheet or web of thermoplastic material as discussed in more detail below, and are heat sealed together at their front and bottom edges as illustrated in FIG. 2 at 19 to form a seam 21. This stitchless construction does not result in holes extending through the material which would compromise its effectiveness to prevent passage of contamination. It should be noted that neither the top 22 nor rear edges 23 of the panels are heat sealed together, although the lower portion of the latter includes thermal "tacks" 24 for a purpose which will be described hereinafter. (It should be noted that the tacks 24 could be adhesive.)

The rear section of each of the sidewall panels 17 and 18 includes a tab portion 26 which extends outwardly beyond the shoe covering portion of the boot and includes a dual sided pressure sensitive type adhesive tape 27 having a covering 28 for protecting the exposed adhesive. Ideally, the tab portions 26 of the panels making up a boot portion are heat-welded together to strengthen the boot portion at their location and to minimize the effects at such location of shear forces tending to separate the sidewall panels.

FIG. 2 is an elevation view of the disposable shoe covering shown in FIG. 1. However, because each side of the shoe covering essentially is a mirror image of the other side, it appears that only one side is shown. It will be appreciated that the boot portion panel 17 is hidden by the boot portion panel 18 and there are two rear sections 26, each of which has an adhesive tape and covering set 27 and 28.

The simplicity with which the shoe covering of the invention is applied will be apparent from the following. The boot portion is shaped and sized to accommodate a range of shoe sizes, including the larger shoes in such range. It is a semi-rear entry design and a wearer only has to pull the two sheets apart at the opening formed at the edges 22 and 23, and thrust his/her foot into the same. In this connection, the tacking 24 facilitates use of the shoe covering with smaller shoe sizes. That is, when a smaller shoe is inserted through the opening, the tacked edges of the two sidewall sheets will only be torn apart to the extent necessary for the shoe to fit as it is thrust into the boot. The mating portion of the sidewalls at the boot edge 23 which are not separated from one another, remain tacked together to facilitate such wrapping.

Once the covering is so applied, the next step for the wearer is simply to tightly wrap around the excess material at the rear of the covering by firmly pulling the rear portion of the shoe covering forwardly, remove the protective covering on the pressure sensitive adhesive tape closest to the boot portion, and secure the wrapped around portion to the side of the boot portion. This securance typically will be at the side arch of the shoe. Moreover, the provision of two adhesive tapes, one on each of the panels 17 and 18, facilitates wrapping and securance in either direction, thus avoiding any "left" or "right" wrapping or foot bias. In this connection, the sole of the shoe covering is slightly rounded as is illustrated in FIG. 2 so that the point of securance will be slightly raised above the shoe sole to encourage fastening along the shoe side rather than along the shoe sole.

This gently curved shape of that section of the boot portion designed to encompass a shoe sole has the additional advantage of conforming to the shape of the sole of most shoes. As illustrated, such section terminates adjacent the forward end of such section with a more steeply curved shape to conform with the front part of the sole of most shoes.

It will be seen that this securance will also automatically adjust the fit of the boot portion over the shoe sole and heel to obtain the desired snug fit. A wearer will automatically pull the rear section of the covering forward toward the toe of the boot portion before securing the same. A snug fit at the shoe sole and heel is thereby obtained, with the result that there is little or no slippage during walking between the covering and the wearer's shoe sole and heel. In other terms, the wrapping automatically gathers the excess material of the boot portion which is not needed for the boot to snugly fit a particular wearer's shoe, and secures it to that portion of the boot which is being used to cover the shoe. Surer footing is thus obtained. The taut covering of the invention essentially "conducts" the tread of the shoe effectively to the floor. It should be noted that the relatively wide rear entry opening encourages rapid application.

Most desirably, the material of the boot portion has texture on the same to enhance its resistance to slipping, both on the floor and relative to the sole of the shoe of the wearer. Moreover, it is contemplated that in some situations it may be desired to include an appropriate powder or a "limited stick" or textured strip within the boot portion, such as at its bottom, to prevent a wearer of either an unusually slippery shoe or even a standard shoe cover underneath the shoe cover of the invention, from slipping.

The covering of the invention is designed to accommodate individuals who have particularly small feet and shoes who do not wish to secure the boot portion on the upper portion of the vamp of the covering adjacent the toe. That is, the material can be "reefed" or "furled" before it is secured to the side of the shoe. This folding of the material upon itself is illustrated in the partial view of FIG. 3. The inclusion of pressure sensitive adhesive tape on both sides of the rear end tab section facilitates this furling by enabling the rear tab section of a covering to be initially secured to itself by one of such adhesive tapes, before securance of the remaining rear portion of the covering with the other adhesive tape in the usual way.

The covering of the invention is simply removed for disposal after it has served its purpose. That is, each sidewall panel 17 or 18 is provided with a weakened linear section defined, in the preferred embodiment, by a scored line 29 extending from the insertion opening downwardly along the side of the covering. Thus, a user simply has to apply a tearing force to the covering to remove the same. The scored line will respond to such force by tearing. It should be noted that the furling mentioned above enables the wearer of a small shoe to prevent wrapping of material over the weakened linear section and interfering with its use to facilitate removal of the covering. Most desirably, a tab 31 is provided on each side of the boot portion adjacent the scored line for grasping to apply the tearing force. As illustrated, each tab 31 is located at the top of the boot, a location which is selected to minimize potential contamination of the same as well as to assure that the tabs cooperate with the scored line. It will be appreciated that the weakened linear section provided by the scored line could be provided by means other than simple scoring.

The boot is shaped not only to generally conform to the shape of a shoe, but also to minimize wastage during production. This is illustrated in FIG. 4 in which a plurality of boot sidewall sections, such as sidewalls 18, are laid out on a single web or sheet of material 32. As illustrated, the front and rear ends of the boot portions are shaped so that during manufacture the sidewalls will nest with similarly shaped sidewalls. Each of the boot portions has a generally concave section at its front to accommodate the toe of an adjacent section as illustrated, and the rear is generally straight to coincide with the rear of another, with the result that sheet material wastage can be minimized by cutting from such sheet alternately reversed and flipped configurations of boot portion panels.

FIGS. 5–7 illustrate an alternate embodiment of the invention designed not only to encompass a shoe and ankle of a wearer but also to encompass the wearer's pants up to his/her knee, i.e., cover the calf of the wearer's leg. This knee-high covering is generally referred to in the drawings by the reference numeral 41. The lower portion of the same is essentially the same in construction and has the same features as the embodiment of FIGS. 1–4. For this reason, the same reference numerals are used for like and similar parts, except they are primed.

One difference between this embodiment and the one described earlier is that this embodiment is not a rear entry embodiment. Rather, it is open at the top as illustrated and includes an extended section 42 at the top adjacent such opening having a pressure sensitive adhesive tape 43 extending from the same. It is desirable that the pressure sensitive tape be covered and be provided on both sides of the section 42 to enable the upper opening to be wrapped for closure in either direction transverse of the leg. The provision of this upper closing enables one to provide a large opening and upper leg section with the knowledge that all excess material at the opening will be gathered.

It should be noted that this wrapping is generally independent of the wrapping adjacent the shoe to obtain the snug sole fit. That is, while it does operate to close the opening and thereby allow the opening to be sufficiently large to accommodate differently sized shoes, it has no effect on the snug fit at the shoe, and the lower tape and wrapping is necessary.

The scored line 29' of this embodiment extends from the opening at the top, down to adjacent the wearer's shoe as illustrated. Thus, the tearing force which is applied to remove the covering will result in tearing for its full length. It should be noted that the tab 31' for grasping to provide the tearing force is positioned on the covering to be behind the wearer's knee, again at a location at which potential contamination will be minimized.

As a salient feature of this embodiment, it includes a gas permeable ventilation section 44 positioned posterior of the wearer's calf and, thus, spaced away from the wearer's shoe. This section can be provided, for example, by small openings (pin pricks) in such section. (A separate panel of a breathable material also could be provided.) One of the complaints of previous "knee-high" designs is that they are hot, i.e., do not provide ventilation. With the instant invention there are no ties, tapes or elastic gathers adjacent the wearer's ankle to trap in the normal heat and moisture released by a foot. Thus, movement of the wearer's leg will result in an air "pumping" action to facilitate cooling. That is, such movement will result in an exchange of air through the upper permeable section.

It should be noted that the gas permeable ventilation section is located at a point at which its presence does not materially add to potential contamination, i.e., at the upper posterior calf behind the wearer's knee.

This embodiment of the invention is designed to facilitate dispensing for use. Each of the panels includes at its upper end a pair of hanger tabs 46 designed to cooperate with a rack 47, as illustrated in FIG. 7, for hanging of a plurality of the shoe coverings. The rack can be mounted just outside an area at which shoe coverings are to be used, and those who enter such area simply can pull open and remove a covering from the same for rapid, step-in application.

Although preferred embodiments of the invention have been described to conform with the requirements of the patent statutes, it will be appreciated by those skilled in the art that various changes and modifications can be made without departing from the spirit of the invention. For example, although only "knee-high" and "sock-high" embodiments have been described, it will be recognized that the invention is also applicable to hip or waist coverings or even total body protective suits. In some uses it may be desirable to include antimicrobial or other contaminant resistant coatings on the sole of the boot portion and on the tear away tabs and/or to include an anti-slip and/or moisture absorbent strip or powder within the boot. Moreover, although both of the embodiments are made from a single material, it is within the scope of the invention to use more than one material. For example, in the second embodiment or in other embodiments it may be desired to use thin woven fabric or other breathable water resistant material for an upper portion which extends above the shoe of a wearer. It is intended that the coverage afforded applicant be limited only by the terms of the claims and their equivalents.

What is claimed is:

1. A disposable shoe covering to be applied over a shoe comprising a boot portion of a flexible material for covering the vamp, sole and heel of said shoe, and means for both adjusting the fit of said boot portion over said shoe, sole and heel to obtain a snug fit and securing said portion on said shoe; said means for both adjusting the fit of said boot portion over said shoe sole and securing said portion on said shoe also securing to the boot portion covering said wearer's shoe, that excess material making up said boot portion which is not needed for said boot portion to snugly fit about said wearer's shoe, said means being adapted to secure said excess material to said boot portion after said excess material is wrapped around said boot portion toward either of the two sides of said wearer's shoe; and wherein said means for securing is a pressure sensitive adhesive provided on both side surfaces of the same rear end section of said boot portion.

2. A disposable shoe covering to be applied over a shoe comprising boot portion of a flexible material for covering the vamp, sole and heel of said shoe, and means for both adjusting the fit of said boot portion over said shoe, sole and heel to obtain a snug fit and securing said portion on said shoe; said means for both adjusting the fit of said boot portion over said shoe sole and securing said portion on said shoe also securing to the boot portion covering said wearer's shoe, that excess material making up said boot portion which is not needed for said boot portion to snugly fit about said wearer's shoe, said means being adapted to secure said excess material to said boot portion after said excess material is wrapped around said boot portion toward either of the two sides of said wearer's shoe; and wherein the material of said boot portion includes a weakened linear section which preferentially tears when a tearing force is applied to said covering to remove the same from a wearer's shoe.

3. The disposable shoe covering of claim 2 further including a tab adjacent said weakened portion for grasping to apply said tearing pressure thereto, the location of said tab being selected to minimize potential contamination thereof.

4. The disposable shoe covering of claim 3 wherein there are two of said weakened sections on opposite sides of said shoe covering; and there are two of said tabs, each of which is associated with a corresponding one of said weakened sections.

5. A disposable shoe covering to be applied over a shoe comprising a boot portion of a flexible material for covering the vamp, sole and heel of said shoe, and means for both adjusting the fit of said boot portion over said shoe, sole and heel to obtain a snug fit and securing said portion on said shoe; said means for both adjusting the fit of said boot portion over said shoe sole and securing said portion on said shoe also securing to the boot portion covering said wearer's shoe, that excess material making up said boot portion which is not needed for said boot portion to snugly fit about said wearer's shoe, said means being adapted to secure said excess material to said boot portion after said excess material is wrapped around said boot portion toward either of the two sides of said wearer's shoe; and wherein said boot portion is elongated to also cover at least the calf of a wearer's leg and includes a gas permeable ventilation section spaced away from that portion designed to cover the sole of a wearer's shoe.

* * * * *